US007264084B1

(12) United States Patent
Switzer

(10) Patent No.: US 7,264,084 B1
(45) Date of Patent: Sep. 4, 2007

(54) TRAY ATTACHMENT FOR A LADDER

(76) Inventor: Mark D. Switzer, 746 S. Ingraham Ave., Lakeland, FL (US) 33801

( * ) Notice: Subject to any disclaimer, the term of this patent is extended or adjusted under 35 U.S.C. 154(b) by 101 days.

(21) Appl. No.: 10/819,426

(22) Filed: Apr. 8, 2004

(51) Int. Cl.
*E04G 1/00* (2006.01)

(52) U.S. Cl. ..... 182/129; 248/238; 206/373

(58) Field of Classification Search ..... 182/129, 182/230, 214, 107; 248/210, 238; 206/372, 206/373

See application file for complete search history.

(56) References Cited

U.S. PATENT DOCUMENTS 4,128,228 A 12/1978 Ziegelmann
D260,754 S 9/1981 Gunnels
4,770,273 A 9/1988 McMakin et al.
5,139,108 A 8/1992 Pate
5,647,453 A * 7/1997 Cassells ..... 182/129
5,653,305 A 8/1997 Duke
5,913,380 A * 6/1999 Gugel et al. ..... 182/129
5,941,344 A * 8/1999 Spadaro ..... 182/129
5,967,259 A * 10/1999 Williams ..... 182/129
6,454,049 B1 9/2002 Dorsett
6,502,664 B1 * 1/2003 Peaker, Sr. ..... 182/129

* cited by examiner

*Primary Examiner*—Hugh B. Thompson, II
(74) *Attorney, Agent, or Firm*—Patent, Copyright & Trademark Law Group, LLC

(57) ABSTRACT

A tool tray support adapted for placement on the top step of a ladder, the support comprising a receptacle for storing construction material and at least one opening formed in the receptacle for supporting a hand tool. The receptacle includes a plurality of cells, the cells dedicated to storing hand tools or materials, thereby maintaining order and organization. The openings are formed so that the elongated portion of the hand tool is inserted therethrough, and the widest portion of the hand tool is suspendingly impinged by the narrower opening. The support includes an electrical cord electrically coupled with an integral electrical outlet, thereby providing electricity from a source to the integral electrical outlet for providing power to an electrical hand tool.

10 Claims, 4 Drawing Sheets

TRAY ATTACHMENT FOR A LADDER

RELATED APPLICATIONS

The present invention contains subject matter that was first described in Disclosure Document Registration 534,528 filed on Jul. 10, 2003 under 35 U.S.C. §122 and 37 C.F.R. §1.14. As such, it is respectfully requested that said Disclosure Document remain a permanent part of the file history of the present application and be relied upon during the pending prosecution, and for any other matters that may arise.

There are no previously filed, nor currently any co-pending applications, anywhere in the world.

1. Field of the Invention

The present invention relates generally to a storage tray apparatus, and, more particularly, to a storage tray apparatus removably attachable to a ladder.

2. Description of the Related Art

There is a seemingly endless list of activities performed at home, work, and in many other environments that require the use of a step ladder in order to allow its user to gain access to areas that otherwise would be inaccessible. However, as handy as these ladders are, they are not without their disadvantages. Perhaps the biggest disadvantage is that they do not provide a work area or storage area for the person on the ladder. This requires the person to carry any tools or supplies needed for the task with them while climbing the ladder, either in their hands, pockets, or tool belt. This obviously compromises safety. Additionally, the situation inevitably arises where the required tool, supply item or material is not on hand and, as a result, time and money are wasted in climbing back down the ladder, tracking the item down and then climbing back up the ladder. Accordingly, there is a need for a means by which workers on a ladder can be afforded a means to hold tools, materials, and supplies in a readily accessible state while increasing safety.

A search of the prior art did not disclose any patents that read directly on the claims of the instant invention; however, the following references were considered related:

U.S. Pat. No. 6,454,049, issued in the name of Dorsett, discloses an electric lift apparatus removably attached to a ladder;

U.S. Pat. No. 6,653,305, issued in the name of Duke, discloses a self propelled step ladder including a moveable platform, wheels and a motor;

U.S. Pat. No. 5,139,108, issued in the name of Pate, discloses a stabilized power winch assembly including a ladder and a winch mounting subassembly vertically moveable along the ladder by a hoist line.

U.S. Pat. No. 4,770,273, issued in the name of McMarin et al., discloses a lifting apparatus having a lifting bar or beam with a winch means pivotally mounted a ladder;

U.S. Pat. No. 4,128,228, issued in the name of Ziegelmann, discloses a hoist for use with a ladder, and U.S. Pat. No. D260,754, issued in the name of Gunnels, discloses an ornamental design for a combined winch and support for securing a ladder.

Consequently, there is a constant need for new products in the tool tray and ladder industries.

SUMMARY OF THE INVENTION

It is therefore an object of the present invention to provide a tool tray support apparatus for placement onto the top step of a ladder.

It is a feature of the present invention to provide a support having a receptacle for storage of materials and tools and an opening for suspendingly supporting a hand tool.

It is another feature of the present invention to provide a support wherein the receptacle has a plurality of cells divided to accommodate and organize tools from materials.

It is another feature of the present invention to provide a support wherein at least one cell is dedicated to storing materials, the cell having divisions for segregating materials and a lid secured thereto.

It is another feature of the present invention to provide a support wherein the openings are formed in the cells dedicated to supporting tools, the openings allowing the shaft of the tool to insert therethrough, the narrow opening supporting and suspending a wider portion of the tool.

Briefly described according to one embodiment of the present invention, a tool tray support adapted for placement on the top step of a ladder, the support comprising a receptacle for storing construction material and at least one opening formed in said receptacle for supporting a hand tool. The receptacle includes a plurality of cells, the cells dedicated to storing hand tools or materials, thereby maintaining order and organization. The openings are formed so that the elongated portion of the hand tool is inserted therethrough, and the widest portion of the hand tool is suspendingly impinged by the narrower opening. The support includes an electrical cord electrically coupled with an integral electrical outlet, thereby providing electricity from a source to the integral electrical outlet for providing power to an electrical hand tool.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted with the FIGS. 1-4.

DETAILED DESCRIPTION OF THE FIGURES

Figure 1:
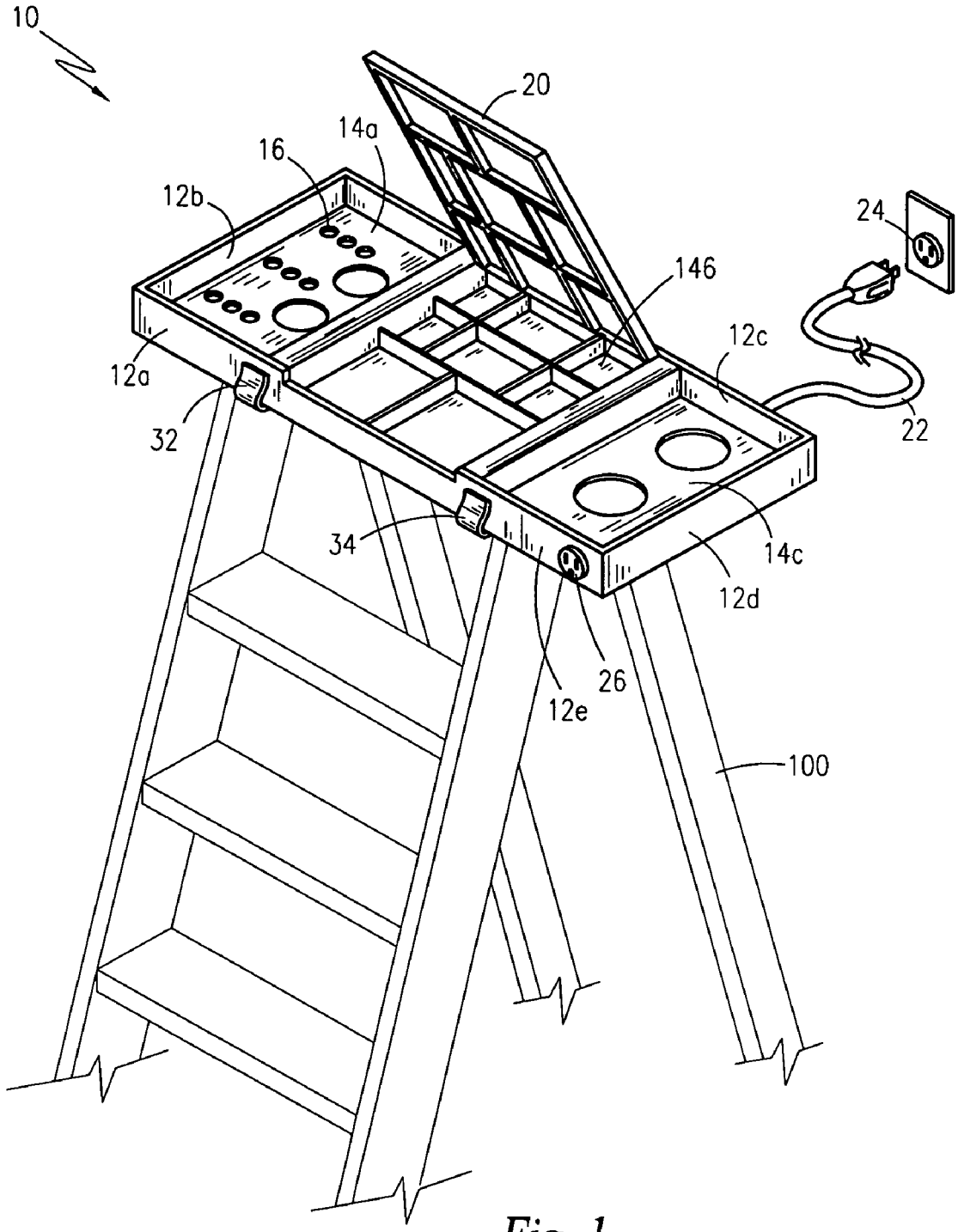
FIG. 1 is a perspective view of a tool tray support apparatus placed onto the top step of a ladder.
Figure 2:
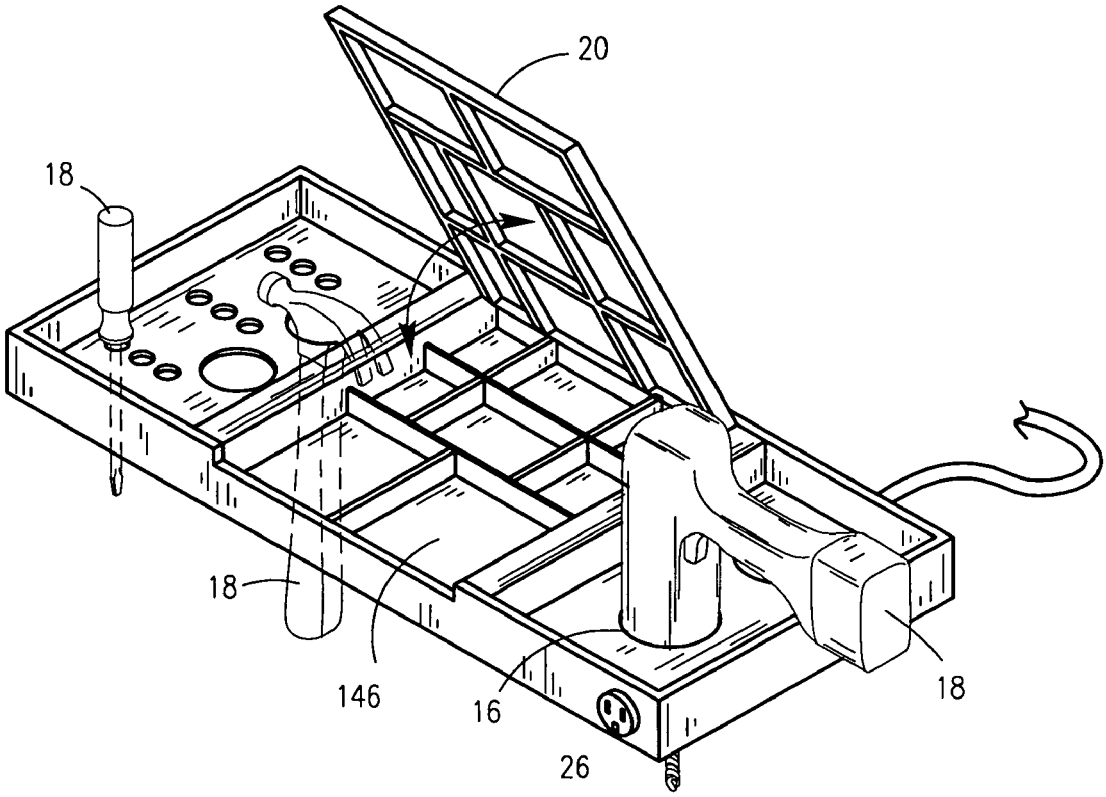
FIG. 2 is a perspective view of the support with the ladder removed.

Referring to FIG. 1 and FIG. 2, a tool tray support 10 adapted for placement or attachment onto the top step of a ladder 100 is shown in accordance with a preferred embodiment of the present invention. The support 10 comprises a receptacle 12 for storing construction material and construction tools. To achieve orderly division of material from tools, the receptacle 12 is partitioned into a plurality of cells, envisioned as at least two cells 14*a* and 14*b*, and further depicted as three cells 14*a*, 14*b* and 14*c*, as an example. Within the plurality of cells 14, at least one opening 16 is provided, and envisioned as a plurality of openings, respectively, the openings provided to suspendingly support a variety of hand tools, generally denoted as 18.

The receptacle 12 is envisioned as having a variety of geometric shapes or forms, including orthogonal (square or rectangular), circular or polygonal, so long as the shape or form does not interfere with the placement or attachment of the support 10 onto the first step of the ladder 100. The receptacle 12 is defined by four walls 12*a*, 12*b*, 12*c* and 12*d* upstanding from a base 12*e* and forming storage space for receipt and housing of the construction materials and/or hand tools. The storage space is defined by cells 14*a*-14*c* organized so that a cell 14*b* is dedicated to storing construction materials, such as screws, bolts, pins, nuts, washers, nails, tacks and other similarly sized materials. The cell 14*b* includes a lid 20 for securely storing the materials and prevent disruption of the storage arrangement or order. The lid 20 may be removably attached (via friction fit interference impingement or other suitable means) or pivotal about a hinge or hinges. The cell 14*b* is shown in a central position (although other positional embodiments are envisioned), thus positioning cells 14*a* and 14*c*, respectively, at either side of cell 14*b*. It is also envisioned that cell 14*b* may be separately extracted from the support 10 (such as an independently extractable storage compartment that may be removed so as to replenish depleted materials inventory without having to remove or detach the entire support 10 from the ladder 100). The cells 14*a* and 14*c* are recessed from a horizontal elevation of cell 14*b*, thereby permitting temporary placement of items or objects therein. The cells 14*a* and 14*c* possess at least one opening 16, and envisioned to possess a plurality of openings 16, the openings 16 traversing the width of the base 12*e* so that ingress and egress through the base 12*e* is achieved. The plurality of openings 16 are of varied diametrical widths to accommodate variously sized hand tools, including the handle of a hammer, the hand grips of wrenches and/or pliers, the cylindrical shafts of screw drivers, and the large widths of power tools, including drills, saws and other similar tools. The openings 16 have a diametral width less than a portion of any hand tool, such as the head of a hammer, the handle of a screw driver, or the jaws of a wrench, so that the openings 16 allow for insertion of the smaller diameter portion and suspend the larger diameter portion within the recessed portion of cells 14*a* and/or 14*c*. As shown, cell 14*a* is dedicated to supporting hand tools having linearly elongated and substantially cylindrical shafts (such as hammers and screw drivers), while cell 14*c* is dedicated to supporting bulkier hand tools (including an electrical drill).

The support 10 may further include an integral electrical cord 22 entering the rear of the receptacle. The cord 22 may be connected to an independent or extraneous electrical outlet 24 so as to provide electricity to an integral electrical outlet 26 provided on an upstanding wall 12*a*-12*d* of the receptacle 12. The cord 22, the electricity delivered through the cord 22 from outlet 24, and the integral electrical outlet 26 are electrically coupled so that an electric hand tool(s) 18 may be powered from the receptacle 12. The integral electrical outlet 26 allows a user to alternate between several electric power tools without having to climb down from the ladder 100 multiple times.

Figure 3A:
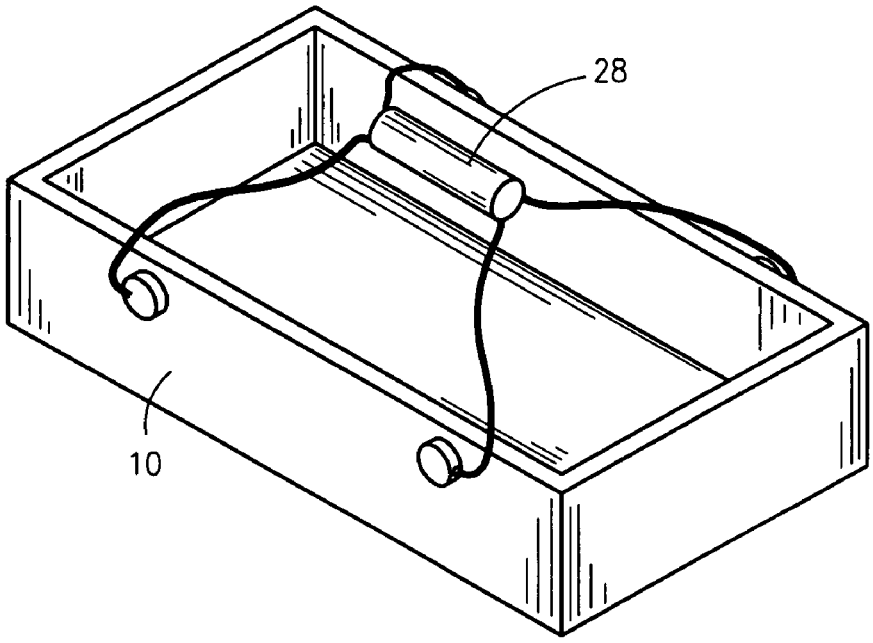
FIG. 3*a* is a perspective view of the support with a handle.
Figure 3B:
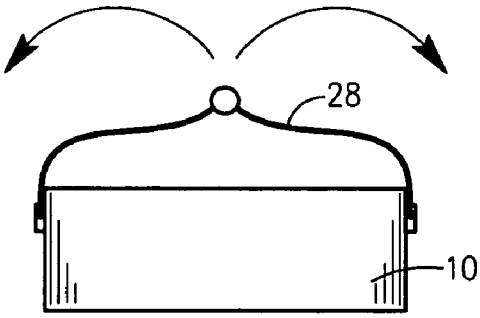
FIG. 3*b* is a side view of the support with the handle.
Figure 3C:
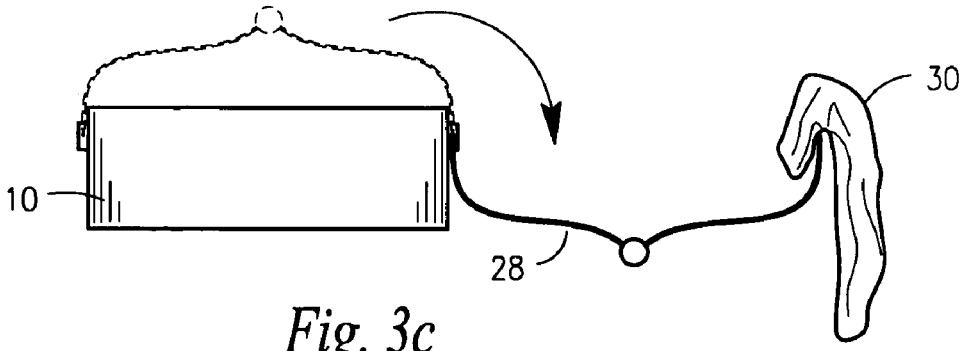
FIG. 3*c* is a side view of the support with the handle pivoted away from the support and holding a cloth.

Referring now to FIG. 3*a* through FIG. 3*c*, the support 10 may further include a handle 28 for facilitating transport of the support 10. The handle 28 is envisioned as being pivotal so that the handle 28 does not obstruct the use of the support 10, and further, so as to provide means for support a cloth or cloths 30. As shown, the handle 28 pivots away from the support 10 into a position upon which a cloth 30 may be temporarily placed until it is needed.

It is further envisioned that a kit comprising the combination of the support 10 and a plurality of hand tools and materials may be made available. The kit includes the support 10 and the elements and features disclosed above, and further includes hand tools 18 placed into appropriate openings 16 and materials organized and placed within cell 14*b* with the lid 20 secured thereto. Thus, the support 10 may be provided in a form so that a user may purchase not only the support 10, but hand tools and materials necessarily accommodated by the support 10. It is also envisioned that the support 10 and the tools may be color coordinated for appeal and organization.

Figure 4:
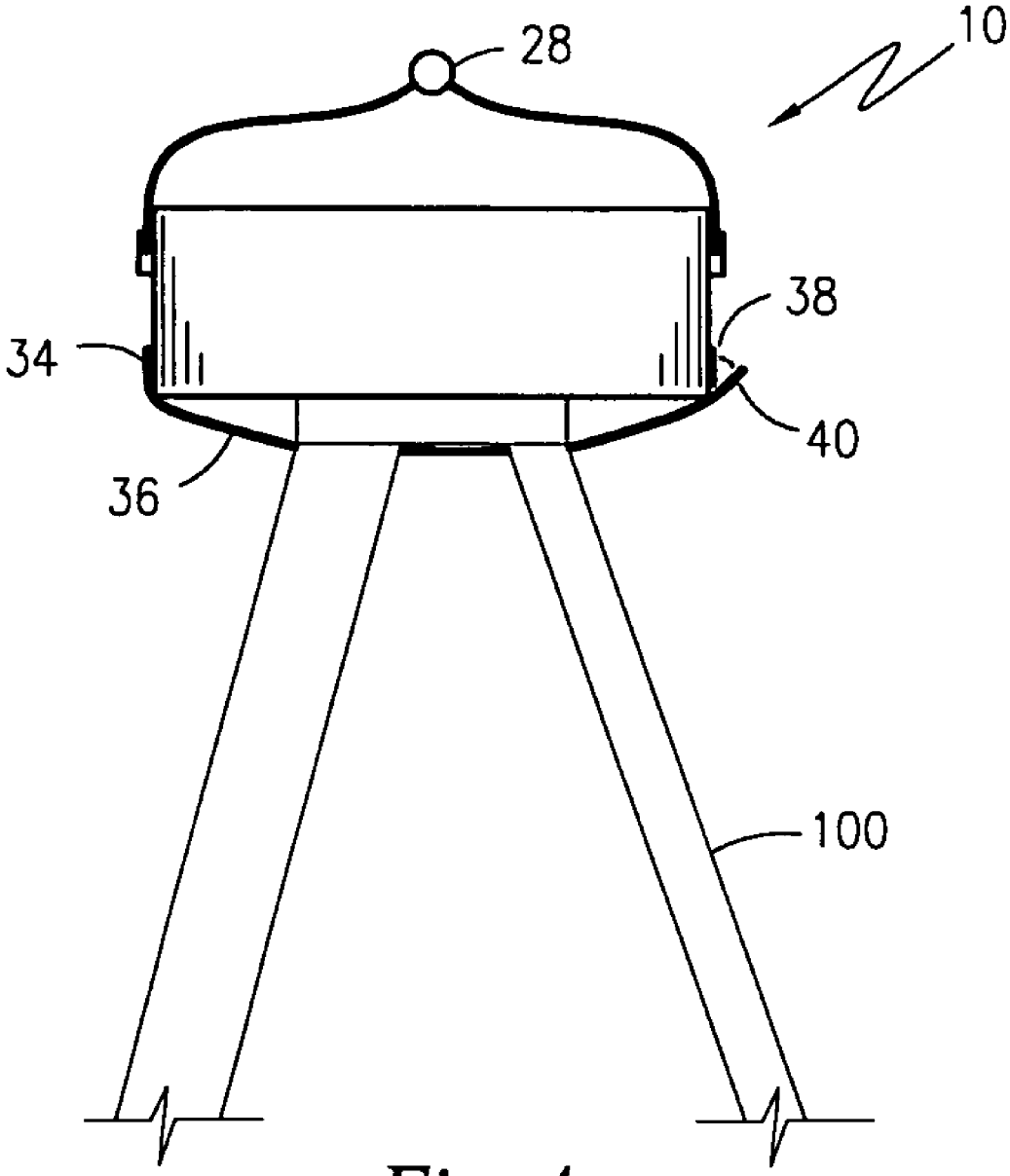
FIG. 4 is a side view of the support attached to the ladder via elastic members that circumscribe the top step of the ladder.

Referring now to FIG. 1 and FIG. 4, the support 10 is shown attached or affixed to the top step of the ladder 100. Attachment is accomplished by a pair of members 32 and 34 that are permanently affixed to either the front or the rear of the support 10 (preferably along upstanding walls 12*a* or 12*c*), routed beneath the support 10 and circumscribing the top step of the ladder 10 upon which the support 10 rests. The members 32 and 34 comprise an elastic or returnably resilient band of materials 36 that spans from the front to the rear of the support 10. The members 32 and 34 are then attached or affixed to the opposing front or rear (again, preferably along the opposing upstanding wall 12*a* or 12*c*) by hook and loop material, wherein the members 32 and 34 possess either the hook or loop material and the surface possesses the corresponding hook or loop material. For illustrative purposes only, the rear surface is shown possessing the loop material 38 and the terminal end of the band 36 is shown possessing the hook material 40.

OPERATION OF THE PREFERRED EMBODIMENT

The preferred embodiment of the present invention can be utilized by the common user in a simple and effortless manner with little or no training. The support 10 may be placed or attached to the top step of a ladder 100 and secured by members 32 and 34, in which the bands 36 are stretched beneath the support 10 to circumscribe the top step of the ladder 100 and then securely affixed to an opposing surface of the support 10. Hand tools 18 may be inserted through an opening(s) 16 and suspended therein when not in use. Materials may be placed within cell 14*b* and the lid 20 articulated from a opened to a closed position, securing the items therein. The cord 22 may be plugged into an outlet 24 to generate electricity for the integral electrical outlet 26 formed in the walls 12*a*-12*d* of the receptacle 12.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A tool tray support adapted for placement on a top step of a ladder, said support comprises:

a rigid receptacle having a plurality of cells provided as a means to store construction material and an attachable lid thereon;

at least one aperture formed through a top of said receptacle to support a suspended hand tool; and a pair of members, a first end of said pair of members is permanently affixed to a length of said support at one end and the second of said pair of members is removably attached to said length of said support at the opposite end;

wherein said pair of members are flexible elastic bands that clip and bound said support about a length of said top step.

2. The support of claim 1, wherein said plurality of cells comprises:

a first cell having a plurality of different sized compartments that separate and contain said materials in the internal spaces formed by the attachable lid; and, a second uncovered cell that extends beyond the length of said top step to provide a means to accommodate and to support a tool suspended through said at least one aperture.

3. The support of claim 2, wherein said plurality of different sized compartments accommodate the storage of said materials including screws, washers and nuts.

4. The support of claim 2, wherein a plurality of different sized apertures are comprised on said second cell to support a plurality of different sized tools.

5. The support of claim 2, wherein said plurality of cells further comprises a third uncovered cell that extends beyond the length of said top step opposite said second cell to provide a means to accommodate and to support at least one additional hand tool suspended through at least one additional aperture.

6. The support of claim 1 further comprises a plurality of apertures formed through said receptacle to support a plurality of suspended hand tools.

7. The support of claim 1 further comprises an electrical cord that extends from said receptacle to be plugged into an independent electrical outlet, said electrical cord is provided as a means to supply electricity to an electric hand tool through an integral electrical outlet comprised on a wall of said receptacle.

8. The support of claim 1 further comprises a transport handle that pivots away from said support to form a hook that supports a hanged cloth when said support is utilized.

9. A kit comprising the combination of:

a tool tray support adapted for placement on a top step of a ladder, said support comprises a rigid receptacle provided as a means to store construction material and a plurality of apertures formed through a top of said receptacle to support suspended hand tools;

a first end of a pair of members permanently affixed to a length of said support at one end and a second end of said pair of members removably attached to said length at the opposite end, said pair of members are flexible elastic bands that clip and bound said support about the length of said top step;

a plurality of different sized hand tools, each one of said plurality of hand tools is suspended from one of the corresponding sized plurality of apertures; and a plurality of materials stored in a plurality of different sized compartments comprised on said receptacle, said compartments separate and contain said materials in internal spaces formed by means of an attachable lid.

10. The support of claim 9, wherein said plurality of apertures are comprised on an uncovered portion of said receptacle that extends beyond the length of said top step to provide a means to support said plurality of tools suspended through said plurality of apertures.

* * * * *